US006604766B2

(12) United States Patent
Hassell

(10) Patent No.: US 6,604,766 B2
(45) Date of Patent: Aug. 12, 2003

(54) FIBERGLASS INSULATION INSTALLER

(76) Inventor: Donald S. Hassell, 37 Westdale Rd., Holbrook, MA (US) 02343

( * ) Notice: Subject to any disclaimer, the term of this patent is extended or adjusted under 35 U.S.C. 154(b) by 0 days.

(21) Appl. No.: 09/967,803

(22) Filed: Oct. 1, 2001

(65) Prior Publication Data

US 2003/0062733 A1 Apr. 3, 2003

(51) Int. Cl.[7] ..... B25J 1/00
(52) U.S. Cl. ..... 294/19.1; 294/24; 294/119.1
(58) Field of Search ..... 294/19.1, 22, 23, 294/24, 50.8, 119.1; 81/53.1, 53.11, 53.12; 7/114, 170

(56) References Cited

U.S. PATENT DOCUMENTS 4,863,204 A * 9/1989 Peters ..... 294/19.1
5,301,378 A 4/1994 Schultz
5,941,587 A * 8/1999 Wolff et al. ..... 294/19.1
6,017,070 A * 1/2000 Poppa ..... 294/19.1
6,048,010 A 4/2000 Stocker

* cited by examiner

*Primary Examiner*—Dean J. Kramer
(74) *Attorney, Agent, or Firm*—D. Michael Burns

(57) ABSTRACT

A tool for installing fiberglass insulation. The tool having a handle with a telescopically movable post for extending its length. The tool having a grasping portion for holding the insulation. The grasping potion comprising of a pair of gripping plates, each with a stabilizing strip attached thereto. A cam flange section integral with the tops of the plates and having a pair of arc shaped slots for sliding engagement with the plates. Rotation of the handle causing the plates to either open or close.

4 Claims, 3 Drawing Sheets

FIBERGLASS INSULATION INSTALLER

BACKGROUND OF THE INVENTION

1. Field of the Invention

The present invention relates generally to a tool for use in the installation of fiberglass insulation or rock wool in residential and commercial buildings, and more specifically a tool designed to insert such insulation in the roof rafters of previously constructed homes.

2. Description of the Prior Art

Fiberglass insulation and rock wool are the two most common types of insulation used on previously constructed homes. When they are installed the workmen must be constantly cutting and sizing the sheets of insulation. The insulation is usually supplied in the form of rolls. The installer will usually cut with a knife manageable lengths of the material. As the material is installed in the rafters the installer will usual note a witness mark for the previously installed section. This is because the next sheet of insulation is pushed inward to a length less the predetermined amount the units of insulation have been cut. This is to accommodate the slope and therefore shorter sections are required. At present there is no tool available to provide the installer an easy yet effective means for judging this distance and having a tool that will of itself accommodate these differences.

The prior art does disclose some patents that have anticipated the problems of installing these types of insulation. One such patent was issued to Schultz on Apr. 12, 1994. This was U.S. Pat. No. 5,301,378 which taught of a tool for installing fiberglass insulation. Although quite different in construction from the present invention, it was the only patent that addressed the subject.

Other patents such as U.S. Pat. No. 6,048,010, issued to Stocker on Apr. 11, 2000, teach of tools for manipulation of material sections to overhead heights.

None of the above inventions and Patents, taken either singly or in combination, are given to describe the instant invention as claimed.

SUMMARY OF THE INVENTION

Accordingly, the above problems and difficulties are obviated by the present invention which provides for an installation tool designed to be adaptable for differences in rafter heights or lengths. The present invention is designed to insert sheets of insulation, in previously constructed homes and buildings, between the roof rafters of difficult to reach places such as dormers. The insulation is cut into manageable size sheets for insertion into the roof and eaves of the building. The present invention is opened by rotating a handle thereby operating a cam slotted flange. A sheet of insulation is placed between a pair of gripping plates and the handle is rotated in a counterclockwise direction to securely grasp the sheet. The user need only to reverse the handle direction to release the sheet. As the sheets of insulation are installed, beginning at the furthermost point, a witness mark is noted on the handle of the tool. By precutting the insulation sheets the installer can coordinate the distance the sheets must be pushed into position, noting with a witness mark this distance on the handle. The handle of the tool is adjustable lengthwise and as previously mentioned can be marked in increments corresponding to the precut installation sheets. To insure that there be no appreciable gaps, an adjustable rod (not part of inventive concept) is applied to the top surface of each bay as it is filled, thereby allowing for an air space for venting and prevention of moisture traps.

The present invention can be dismantled slightly so that the handle portion can be removed from the cam operated gripping plates. This feature is especially useful wherein a tamper add-on can be affixed to the distal end of the handle section to aid in aligning the insulation material as they are installed.

Accordingly, it is a principal object of the invention to provide an installation tool that will grasp the insulation material that is to be pushed into position, while also allowing the installer to be able to know how far he must push by visually noting the witness marks on the handle.

It is another object of the invention to provide an installation tool that is very inexpensive since insulating one's home would be done so rarely that the tool would almost have to be considered a one application tool, however it must be built rugged enough for use by the professional installer of insulation.

It is an object of the invention to provide a tool that not only would be used to install the insulation material but which is adjustable in length.

It is another object of the invention to provide a tampering tool that could also be used to "tap" the insulation sections into position.

These and other objects of the present invention will become readily apparent upon further review of the following specification and drawings.

DETAILED DESCRIPTION OF THE PREFERRED EMBODIMENT

Figure 1:
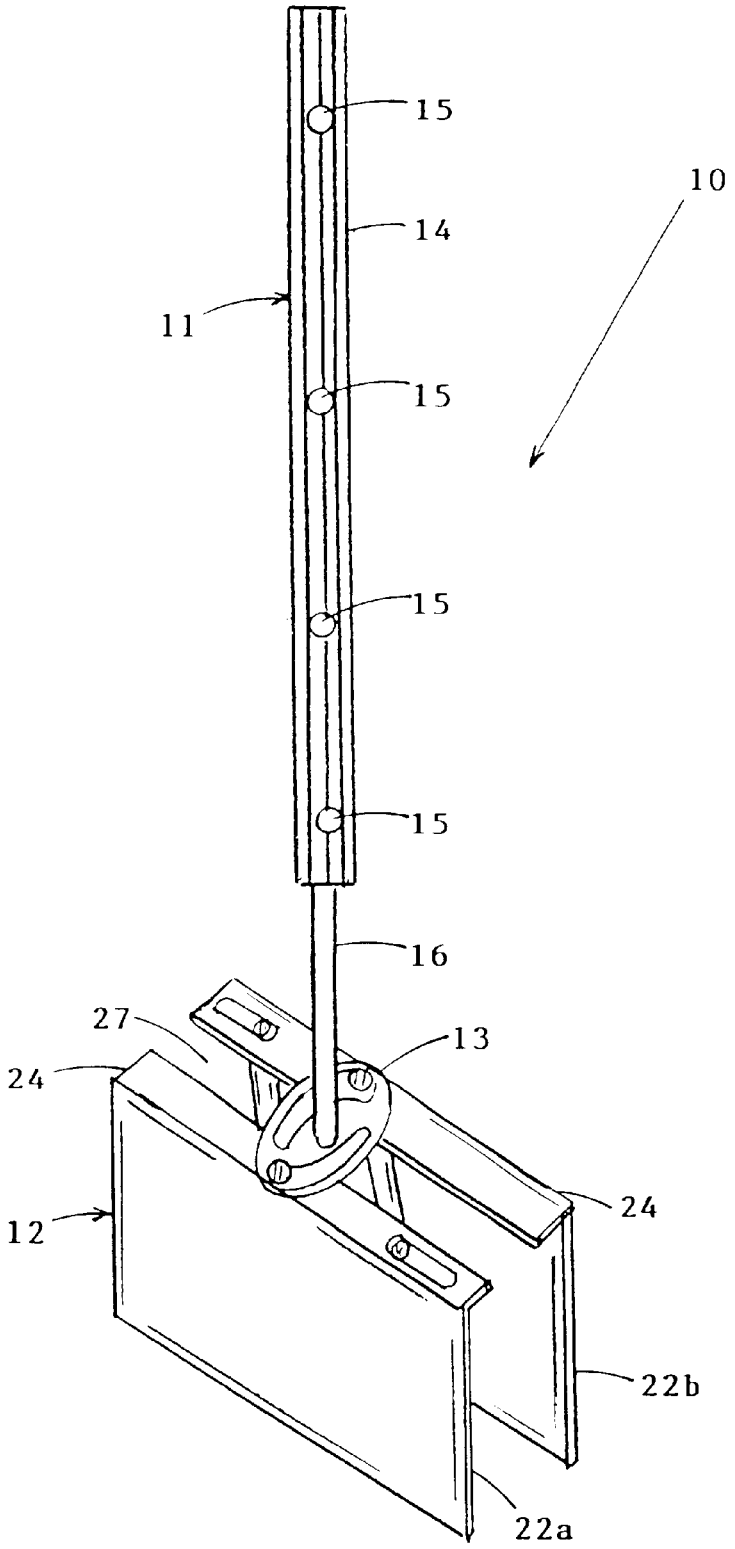
FIG. 1 is a perspective elevation view of the present invention in an open position.

Referring to FIG. 1, the present invention is shown as it might appear when opened and ready to grasp a sheet of fiberglass insulation. The installation tool of the present invention 10 comprises a longitudinal axis and an elongated handle portion 11 integrally connected to a grasping portion 12 by means of a cam flange disk 13.

Figure 2:
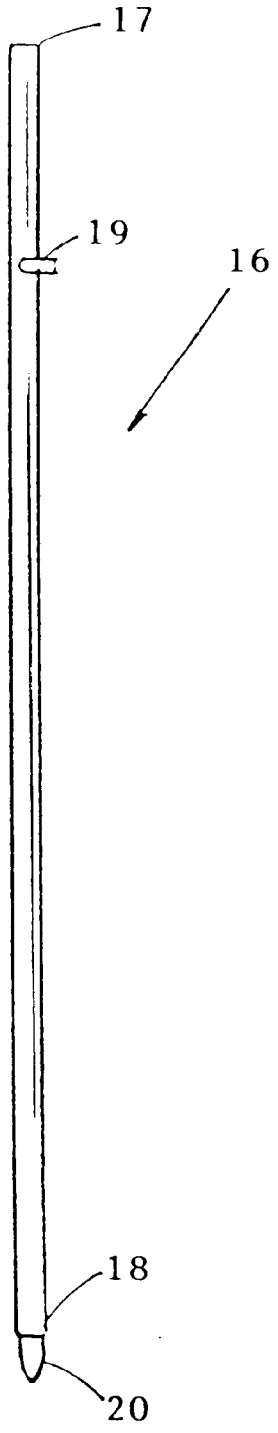
FIG. 2 is an elevation view of the post section removed from the sleeve section.
Figure 3:
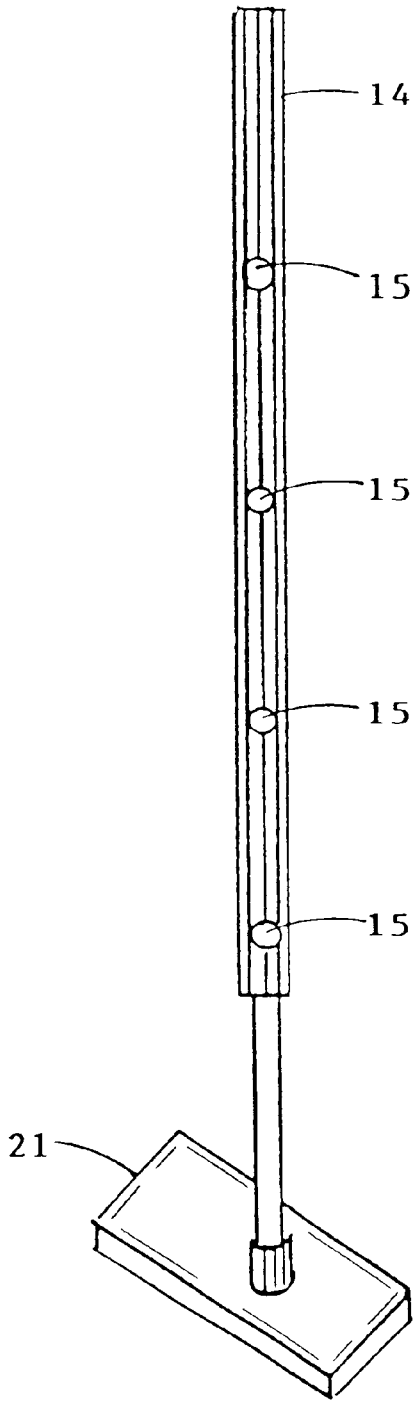
FIG. 3 is a perspective view of the handle portion affixed with a tampering block.
Figure 4:
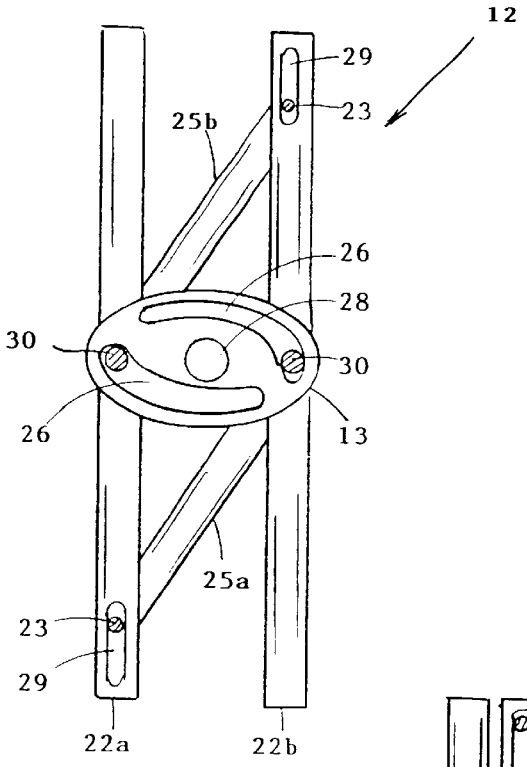
FIG. 4 is a top view of the grasping portion in an open position.
Figure 6:
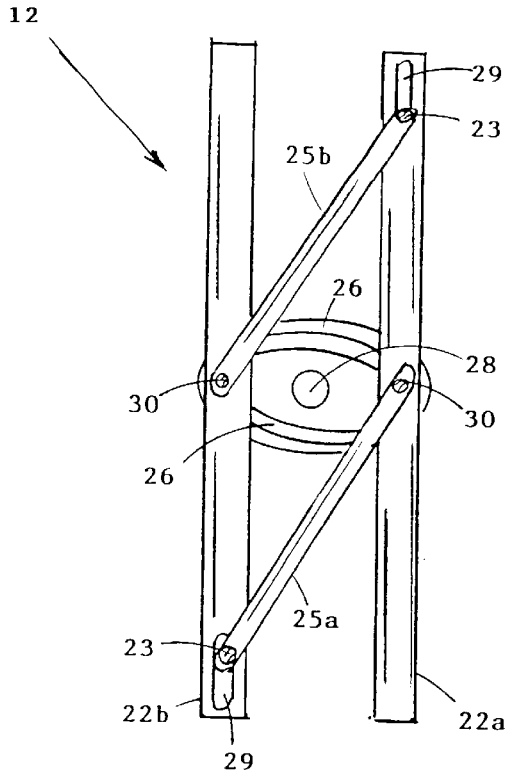
FIG. 6 is a bottom view of the grasping portion in an open position.
Figure 5:
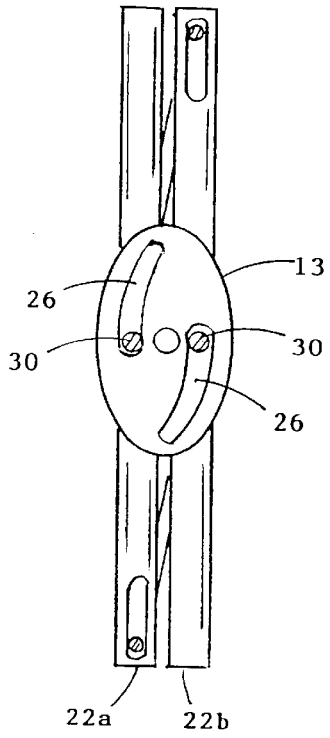
FIG. 5 is a top view of the grasping portion in a closed position.

As shown in FIG. 1, the handle portion 11 is comprised of a hollow sleeve section 14 having an outer surface fluted for easy handling. Sleeve section 14 is coaxial with the longitudinal axis of the tool 10 and preferably of a tubular shape and made of appropriate material such as plastic or lightweight metal. Sleeve section 14 having a plurality of equidistantly spaced openings 15 in the shell of the sleeve 14. The handle portion 11 also comprising an elongated post member 16 which is interposed coaxial within the sleeve section 14, such that it may slide within the axis of the sleeve 14 to thereby extend or shorten the length of the handle portion 11. The post 16 having a proximal end 17 and a distal end 18 as shown in FIG. 2. The post 16 further having at least one spring loaded button 19 which when properly aligned with one of the openings 15 of the sleeve section 14 will retain the post 16 at that position in the sleeve 14. The distal end 18 of the post 16 having a rounded tip 20 which is friction fitted to a circular hole 28 in the cam flange disk 13 of the grasping portion 12. This tip 20 may also be friction fitted to a tampering block 21 as illustrated in FIG. 3. This creates a tool that can be used to "tap down" the fiberglass sheets to insure a smooth and tight fit.

The grasping portion 12 as illustrated in FIGS. 1, 4–6, is comprised of a pair of angle iron shaped gripping plates, a first gripping plate 22*a* and a second gripping plate 22*b*, which are maintained in a parallel relationship to each other by the movement of the cam flange disk 13. Two arc shaped slots 26 are defined in the cam flange disk 13. Each of the gripping plates 22*a* and 22*b*, having lip sections 24 formed in their upper areas, are attached to the cam flange disk 13 by a connecting pin 30. A pair of stabilizing strips, a first stabilizing strip 25*a* and a second stabilizing strip 25*b*, each having opposing ends: one end of the first stabilizing strip 25*a* being rotationally attached to the first gripping plate 22*a* by one of the connecting pins 30, while one end of the second stabilizing strip 25*b* being rotationally attached to the second gripping plate 22*b* by the other connecting pin 30; the other end of the first stabilizing strip 25*a* being in a sliding relationship with the opposing second gripping plate 22*b* by a lug nut 23 slidingly transposing within an aperture 29 located in the lip section 24 of the second gripping plate 22*b*, and the other end of the second stabilizing strip 25*b* in a sliding relationship with the opposing first gripping plate 22*a* by a lug nut 23 slidingly transposing within an aperture 29 located in the lip section 24 of the first gripping plate 22*a*.

Upon the handle portion 11 being rotated, the gripping plates 22*a* and 22*b* are either opened or closed. When rotated in a counterclockwise direction, plates 22*a* and 22*b* are opened to define a receiving space 27. When rotated in a clockwise rotation, they are therein closed. This is accomplished by the having the arc shaped slots 26*a* and 26*b* of the cam flange section 13 each rotate about a connecting pin 30, whereby the gripping plates 22*a* and 22*b* are either forced open or closed. Providing the tool 10 a degree of structure and strength while being opened or closed is the function of the stabilizing strips 25*a* and 25*b*. One end of the first stabilizing strip 25*a* being rotationally fastened at the center area of the lip section 24 of the plate 22*a* by a connecting pin 30 and at the other end being fastened in a sliding relationship with the outer edge of the lip section 24 of the plate 22*b* by means of a lug nut 23, which is allowed to slide freely within the aperture 29. Conversely, the other stabilizing strip 25*b*, one end being rotationally fastened at the center area of the lip section 24 of plate 22*b* by a connecting pin 30 and the other end being fastened at the outer edge of the lip section 24 of plate 22*a* by means of a lug nut 23 which is allowed to slide freely within the aperture 29. Thus as the plates 22*a* and 22*b* are opened or closed, the stabilizing strips 25*a* and 25*b* each rotate at one end about one of the corresponding connecting pins 30, while the other ends slide within the corresponding apertures 29*a* and 29*b*. This prevents any "buckling" action between the plates 22*a* and 22*b*. Both the connecting pins 30 and the lug nuts 23, have a nut and bolt type of structure. The bottom sections are juxtaposed against the surface of one of the strips 25*a* or 25*b* and resemble the head of a bolt while the upper sections have a nut type structure with an outer diameter larger than either of their respective cam flange slots 26*a* or 26*b* or the apertures 29. Thereby, as they protrude through and are urged in a transverse motion, they are able to maintain the connections therein. Gripping plates 22*a* and 22*b*, stabilizing strips 25*a* and 25*b*, and cam flange section 13 are designed to be manufactured from a lightweight metal or plastic.

A very useful idea that can be employed when using the present invention 10 is to employ witness marks on the handle portion to indicate how far the insulation material needs to be inserted. Whether the application be in a roof, dormer or eave section of the house or building, the fiberglass material will need to be cut into predetermined sizes and then placed into their proper position.

The insulation tool 10 will need to be inexpensively manufactured, yet needs to be rugged enough and strong enough to handle the task. The best materials for construction will be very lightweight plastic for the handle portion 11 and lightweight metal for the grasping portion 12.

Although only one use and embodiment of the present invention has been described in detail hereinabove, all improvements and modifications to this invention within the scope or equivalents of the claims are covered by this invention.

I claim:

1. A tool for installing fiberglass insulation material, the tool comprising:

a handle portion having:

a sleeve section, a telescopic post member coaxially interposed within the sleeve section, whereby the post member can be extended outwardly from the sleeve section to increase the length of the handle portion, means for securing the post member and the sleeve section at various lengths, the post member having a distal end, a cam flange disk having a circular hole defined therein for friction fitting to the distal end of the post member, and the cam flange disk having a pair of arc shaped slots defined therein; and a grasping portion having:

a first gripping plate and a second gripping, for holding the fiberglass material in place during installation, each gripping plate having a lip section formed in its upper area, an elongated aperture defined in each lip section, a pair of connecting pins, each pin connecting one of the plates in a sliding relationship to the cam flange disk, each pin protruding through the lip of one of the gripping plates and interposed in a transverse relationship within one of the arc shaped slots, whereby each arc shaped slot of the cam flange disk slides about one of the corresponding connecting pins to allow the plates to open or close, a first stabilizing strip and a second stabilizing strip, each strip having opposing ends, each having one end rotationally attached to the corresponding first or second gripping plate by one of the connecting pins, the other end attached in a sliding relationship with the opposing first or second gripping plate by means a lug nut interposed within the aperture of the gripping plate, the stabilizing strip to slide transversely within the aperture to enable the gripping plates to open or close, whereby upon rotation of the handle in a counterclockwise direction, the plates will be forced open by the movement of the slots within the cam flange disk around and about the connecting pins, to therein receive a sheet of fiberglass material and upon being rotated in the clockwise direction the plates will be biased toward the closed position thereby securely grasping the fiberglass material.

2. The tool according to claim 1, wherein the means for securing the post member within the sleeve section comprises:

a plurality of equidistantly spaced openings defined in the sleeve section; and a spring loaded button extending from the post member, whereby when the button is aligned and penetrates one of the openings in the sleeve section, the post member is maintained at that position.

3. The tool according to claim 1, wherein the sleeve section has a fluted surface for easy gripping.

4. The tool according to claim 1, wherein a tampering block can be friction fitted with the distal end of the post member to provide a tool for tapping the sheets of fiberglass material into position.

* * * * *